US010878802B2

(12) United States Patent
Yamamoto

(10) Patent No.: US 10,878,802 B2
(45) Date of Patent: Dec. 29, 2020

(54) SPEECH PROCESSING APPARATUS, SPEECH PROCESSING METHOD, AND COMPUTER PROGRAM PRODUCT

(71) Applicant: Kabushiki Kaisha Toshiba, Tokyo (JP)

(72) Inventor: Masahiro Yamamoto, Kawasaki Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/688,590

(22) Filed: Aug. 28, 2017

(65) Prior Publication Data

US 2018/0277094 A1 Sep. 27, 2018

(30) Foreign Application Priority Data

Mar. 22, 2017 (JP) ..... 2017-056168

(51) Int. Cl.
*G10L 13/08* (2013.01)
*G10L 13/04* (2013.01)
(Continued)

(52) U.S. Cl.
CPC ..... *G10L 13/08* (2013.01); *G10L 13/033* (2013.01); *G10L 13/04* (2013.01); *G10L 13/10* (2013.01); *G10L 21/003* (2013.01)

(58) Field of Classification Search
CPC ..... H05K 999/99; G06F 17/289; G10L 15/22; G10L 15/20; G10L 15/265;
(Continued)

(56) References Cited

U.S. PATENT DOCUMENTS 5,113,449 A * 5/1992 Blanton ..... G10L 13/033 704/261
5,717,818 A * 2/1998 Nejime ..... G10L 21/04 381/23.1
(Continued)

FOREIGN PATENT DOCUMENTS

JP H10-258688 9/1998
JP 2003-131700 5/2003
(Continued)

OTHER PUBLICATIONS

Carlyon, R. P., "How the Brain Separates Sounds", Trends in Cognitive Sciences, vol. 8 No. 10, Oct. 2004, 7 pgs.
(Continued)

*Primary Examiner* — Neeraj Sharma
(74) *Attorney, Agent, or Firm* — Knobbe Martens Olson & Bear, LLP

(57) ABSTRACT

A speech processing apparatus includes a specifier, and a modulator. The specifier specifies any one or more of one or more speeches included in speeches to be output, as an emphasis part based on an attribute of the speech. The modulator modulates the emphasis part of at least one of first speech to be output to the first output unit and second speech to be output to the second output unit such that at least one of a pitch and a phase is different between the emphasis part of the first speech and the emphasis part of the second speech.

10 Claims, 14 Drawing Sheets

(51) Int. Cl.
*G10L 13/033* (2013.01)
*G10L 13/10* (2013.01)
*G10L 21/003* (2013.01)

(58) Field of Classification Search
CPC ..... G10L 21/0208; G10L 21/04; G10L 25/87; G10L 25/90; G10L 13/08; G10L 17/005
See application file for complete search history.

(56) References Cited

U.S. PATENT DOCUMENTS 5,781,696 A 7/1998 Oh et al.
5,991,724 A * 11/1999 Kojima ..... G10L 21/04 704/266
6,125,344 A * 9/2000 Kang ..... G10L 21/003 704/201
6,385,581 B1 * 5/2002 Stephenson ..... H04M 3/56 704/258
6,556,972 B1 * 4/2003 Bakis ..... G06F 17/289 704/2
6,859,778 B1 * 2/2005 Bakis ..... G06F 17/289 704/2
7,401,021 B2 * 7/2008 Choi ..... G10L 21/00 704/269
8,175,879 B2 * 5/2012 Nitisaroj ..... G10L 15/1807 704/251
8,364,484 B2 * 1/2013 Yano ..... G10L 25/78 379/100.15
8,798,995 B1 * 8/2014 Edara ..... G06Q 30/0255 704/246
9,691,387 B2 * 6/2017 Nakadai ..... G10L 15/26
9,706,299 B2 * 7/2017 Talwar ..... H04R 3/005
9,854,324 B1 * 12/2017 Panchaksharaiah ..... H04N 21/4884
9,870,779 B2 * 1/2018 Tachibana ..... G10L 19/018
9,922,662 B2 * 3/2018 Sorin ..... G10L 21/013
9,961,435 B1 5/2018 Goyal et al.
2001/0044721 A1 11/2001 Yoshioka et al.
2002/0049868 A1 * 4/2002 Okada ..... G06F 16/313 719/330
2002/0128841 A1 * 9/2002 Kibre ..... G10L 13/10 704/260
2003/0036903 A1 * 2/2003 Konopka ..... G10L 15/065 704/249
2003/0088397 A1 * 5/2003 Karas ..... G06F 17/30017 704/1
2003/0185411 A1 * 10/2003 Atlas ..... G10L 21/0208 381/98
2004/0062363 A1 * 4/2004 Shambaugh ..... H04M 3/51 379/88.01
2004/0075677 A1 * 4/2004 Loyall ..... G06F 3/011 715/706
2004/0143433 A1 * 7/2004 Marumoto ..... H03G 3/32 704/225
2005/0060142 A1 * 3/2005 Visser ..... G10L 21/0208 704/201
2005/0075877 A1 * 4/2005 Minamino ..... G10L 15/08 704/254
2005/0171778 A1 * 8/2005 Sasaki ..... G10L 13/08 704/269
2005/0187762 A1 8/2005 Tanaka et al.
2005/0261905 A1 * 11/2005 Pyo ..... G10L 15/22 704/252
2006/0161430 A1 * 7/2006 Schweng ..... G10L 25/78 704/233
2006/0206320 A1 * 9/2006 Li ..... G10L 21/0208 704/226
2006/0255993 A1 11/2006 Miki et al.
2007/0021958 A1 * 1/2007 Visser ..... G10L 21/0272 704/226
2007/0172076 A1 7/2007 Mori et al.
2007/0202481 A1 8/2007 Smith Lewis et al.
2007/0233469 A1 * 10/2007 Chen ..... G10L 25/69 704/207
2007/0271516 A1 11/2007 Carmichael
2007/0299657 A1 * 12/2007 Kang ..... G10L 19/008 704/207
2008/0069366 A1 * 3/2008 Soulodre ..... G01H 7/00 381/63
2008/0243474 A1 * 10/2008 Furihata ..... G06F 17/289 704/2
2008/0270138 A1 * 10/2008 Knight ..... G06F 17/30026 704/260
2008/0270344 A1 * 10/2008 Yurick ..... G06F 17/30026
2008/0294429 A1 11/2008 Su et al.
2009/0012794 A1 * 1/2009 van Wijngaarden ... G10L 25/48 704/270
2009/0055188 A1 * 2/2009 Hirabayashi ..... G10L 13/10 704/260
2009/0106021 A1 * 4/2009 Zurek ..... G10L 21/0208 704/226
2009/0150151 A1 * 6/2009 Sakuraba ..... G10L 21/028 704/246
2009/0248409 A1 * 10/2009 Endo ..... H03G 3/32 704/226
2009/0319270 A1 * 12/2009 Gross ..... G10L 15/22 704/246
2010/0023321 A1 * 1/2010 Yoshioka ..... G10L 21/003 704/207
2010/0066742 A1 3/2010 Qian et al.
2010/0070283 A1 * 3/2010 Kato ..... G10L 25/87 704/278
2010/0268535 A1 * 10/2010 Koshinaka ..... G10L 15/187 704/236
2011/0029301 A1 * 2/2011 Han ..... G06F 3/04845 704/9
2011/0102619 A1 5/2011 Niinami
2011/0125493 A1 * 5/2011 Hirose ..... G10L 21/003 704/207
2011/0313762 A1 12/2011 Ben-David et al.
2012/0065962 A1 * 3/2012 Lowles ..... G06F 1/1626 704/9
2012/0066231 A1 * 3/2012 Petersen ..... G06F 17/30867 707/748
2012/0201386 A1 * 8/2012 Riedmiller ..... G10L 19/008 381/2
2012/0296642 A1 * 11/2012 Shammass ..... G10L 25/63 704/211
2013/0073283 A1 * 3/2013 Yamabe ..... G10L 21/0216 704/226
2013/0151243 A1 6/2013 Kim et al.
2013/0218568 A1 8/2013 Tamura et al.
2013/0337796 A1 * 12/2013 Suhami ..... H04R 25/00 455/422.1
2014/0108011 A1 * 4/2014 Nishino ..... G10L 25/51 704/246
2014/0156270 A1 * 6/2014 Shin ..... G10L 21/0216 704/231
2014/0214418 A1 * 7/2014 Nakadai ..... G10L 21/0216 704/233
2014/0293748 A1 10/2014 Altman et al.
2014/0337016 A1 * 11/2014 Herbig ..... H04M 3/568 704/201
2015/0012269 A1 * 1/2015 Nakadai ..... G10L 21/0208 704/233
2015/0106087 A1 * 4/2015 Newman ..... G10L 25/78 704/233
2015/0154957 A1 * 6/2015 Nakadai ..... G06F 17/275 704/235
2015/0325232 A1 * 11/2015 Tachibana ..... G10L 13/02 704/268
2015/0350621 A1 12/2015 Sawa et al.
2016/0005394 A1 * 1/2016 Hiroe ..... G10L 15/04 704/248
2016/0005420 A1 * 1/2016 Furuta ..... G10L 21/0332 704/205
2016/0088438 A1 3/2016 O'Keeffe

(56) References Cited

U.S. PATENT DOCUMENTS

| | | | | |
|---|---|---|---|---|
| 2016/0125882 | A1* | 5/2016 | Contolini | H04R 1/08 704/231 |
| 2016/0203828 | A1* | 7/2016 | Gomez | G10L 15/20 704/226 |
| 2016/0217171 | A1* | 7/2016 | Arngren | G06F 17/3082 |
| 2016/0247520 | A1* | 8/2016 | Kikugawa | G10L 21/10 |
| 2016/0275936 | A1* | 9/2016 | Thorn | G10L 13/08 |
| 2017/0148464 | A1* | 5/2017 | Zhang | G10L 21/013 |
| 2017/0162010 | A1* | 6/2017 | Cruz-Hernandez | G08B 6/00 |
| 2017/0243582 | A1* | 8/2017 | Menezes | G10L 15/26 |
| 2017/0277672 | A1 | 9/2017 | Cho et al. | |
| 2017/0309271 | A1* | 10/2017 | Chiang | G10L 13/0335 |
| 2018/0020285 | A1* | 1/2018 | Zass | G16H 50/70 |
| 2018/0070175 | A1 | 3/2018 | Obata et al. | |
| 2018/0130459 | A1* | 5/2018 | Paradiso | G10L 13/04 |
| 2018/0146289 | A1 | 5/2018 | Namm | |
| 2018/0190275 | A1* | 7/2018 | Bhaya | H04L 65/1069 |
| 2018/0285312 | A1 | 10/2018 | Liu et al. | |

FOREIGN PATENT DOCUMENTS

| | | | |
|---|---|---|---|
| JP | 2005-306231 | A | 11/2005 |
| JP | 2007-019980 | A | 1/2007 |
| JP | 2007-257341 | | 10/2007 |
| JP | 2007-334919 | | 12/2007 |
| JP | 2016-080894 | | 5/2016 |
| JP | 2016-134662 | | 7/2016 |
| JP | 2018-036527 | A | 3/2018 |

OTHER PUBLICATIONS

Office Action issued in Japanese application No. 2017-056290 dated Sep. 3, 2019.

Office Action issued in Japanese application No. 2017-056168 dated Sep. 3, 2019.

* cited by examiner

| SPEECH ID | WORD | TIME | NUMBER OF OUTPUTS |
|---|---|---|---|
| 1 | mission | 0:01.0 TO 0:01.5 | 4 |
| 1 | knowledge | 0:30.5 TO 0:31.0 | 4 |
| ⋮ | ⋮ | ⋮ | ⋮ |
| 1 | aspiration | 1:00.0 TO 1:01.0 | 3 |
| ⋮ | ⋮ | ⋮ | ⋮ |

SPEECH PROCESSING APPARATUS, SPEECH PROCESSING METHOD, AND COMPUTER PROGRAM PRODUCT

CROSS-REFERENCE TO RELATED APPLICATIONS

This application is based upon and claims the benefit of priority from Japanese Patent Application No. 2017-056168, filed on Mar. 22, 2017; the entire contents of which are incorporated herein by reference.

FIELD

Embodiments described herein relate generally to a speech processing apparatus, a speech processing method, and a computer program product.

BACKGROUND

It is very important to transmit appropriate messages in everyday environments. In particular, attention drawing and danger notification in car navigation systems and messages in emergency broadcasting that should be notified without being buried in ambient environmental sound are required to be delivered without fail in consideration of subsequent actions.

Examples of commonly used methods for the attention drawing and the danger notification in car navigation systems include stimulation with light, and addition of buzzer sound.

In the conventional techniques, however, attention drawing is made by stimulation that is increased larger than that of the normal speech guidance, thus surprising a user such as a driver at the moment of the attention drawing. The actions of surprised users tend to be delayed, and the stimulation, which should prompt smooth crisis prevention actions, can lead to the restriction of actions.

DETAILED DESCRIPTION

According to one embodiment, a speech processing apparatus includes a specifier, and a modulator. The specifier specifies any one or more of one or more speeches included in speeches to be output, as an emphasis part based on an attribute of the speech. The modulator modulates the emphasis part of at least one of first speech to be output to the first output unit and second speech to be output to the second output unit such that at least one of a pitch and a phase is different between the emphasis part of the first speech and the emphasis part of the second speech.

Referring to the accompanying drawings, a speech processing apparatus according to exemplary embodiments is described in detail below.

Experiments by the inventor made it clear that when a user hears speeches in which at least one of the pitch and the phase is different from one speech to another from a plurality of speech output devices (such as speakers and headphones), the clarity by perception increases and the level of attention increases regardless of the physical magnitude (loudness) of speech. The sense of surprise was hardly observed in this case.

It has been believed that audibility degrades because clarity is reduced in listening of speeches from sound output devices having different pitches or different phases. However, the experiments by the inventor made it clear that when a user hears speeches in which at least one of the pitch and the phase is different from one speech to another with right and left ears, the clarity increases and the level of attention increases.

This reveals that a cognitive function of hearing acts to perceive speech more clearly by using both ears. The following embodiments are enable attention drawing and danger alert by utilizing an increase in perception obtained by speeches in which at least one of the pitch and the phase is different from one speech to another to right and left ears.

First Embodiment

A speech processing apparatus according to a first embodiment modulates at least one of a pitch and a phase of the speech corresponding to an emphasis part, and outputs the modulated speech. In this manner, users' attention can be enhanced to allow a user to smoothly do the next action without changing the intensity of speech signals.

Figure 1:
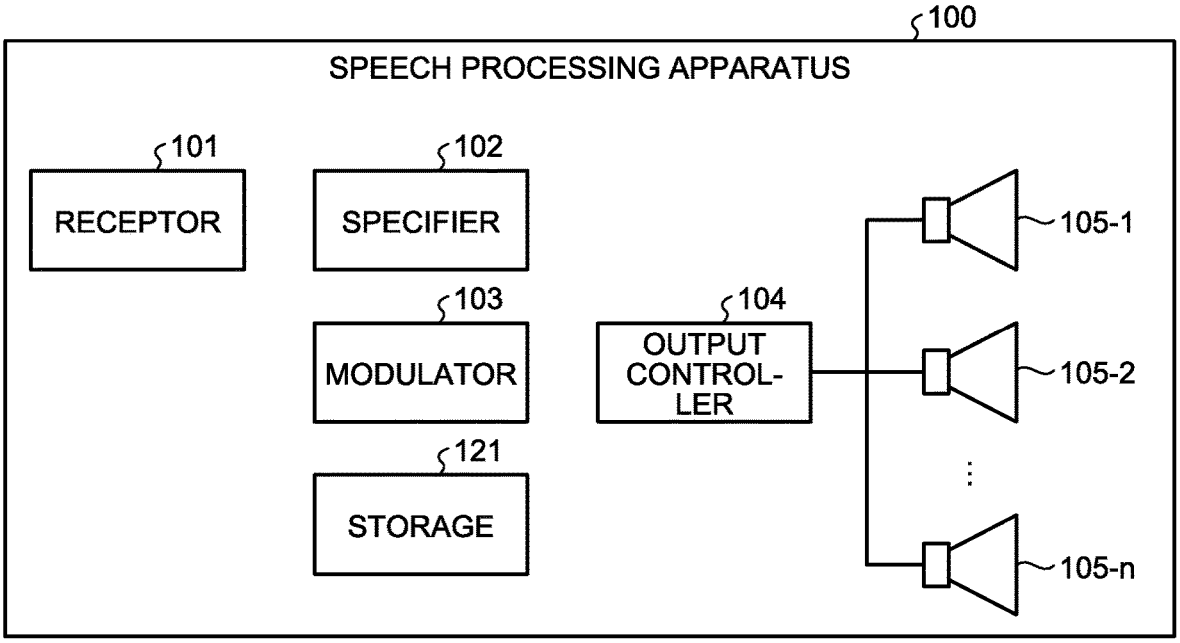
FIG. 1 is a block diagram of a speech processing apparatus according to a first embodiment.

FIG. 1 is a block diagram illustrating an example of a configuration of a speech processing apparatus 100 according to the first embodiment. As illustrated in FIG. 1, the speech processing apparatus 100 includes a storage 121, a receptor 101, a specifier 102, a modulator 103, an output controller 104, and speakers 105-1 to **105-*n*** (n is an integer of 2 or more).

The storage 121 stores therein various kinds of data used by the speech processing apparatus 100. For example, the storage 121 stores therein input text data and data indicating an emphasis part specified from text data. The storage 121 can be configured by any commonly used storage medium, such as a hard disk drive (HDD), a solid-state drive (SSD), an optical disc, a memory card, and a random access memory (RAM).

The speakers 105-1 to **105-*n* are output units configured to output speech in accordance with an instruction from the output controller 104. The speakers 105-1 to 105-*n* have similar configurations, and are sometimes referred to simply as "speakers 105" unless otherwise distinguished. The following description exemplifies a case of modulating at least one of the pitch and the phase of speech to be output to a pair of two speakers, the speaker 105-1 (first output unit) and the speaker 105-2** (second output unit). Similar processing may be applied to two or more sets of speakers.

The receptor 101 receives various kinds of data to be processed. For example, the receptor 101 receives an input of text data that is converted into the speech to be output.

The specifier 102 specifies an emphasis part of speech to be output, which indicates a part that is emphasized and output. The emphasis part corresponds to a part to be output such that at least one of the pitch and the phase is modulated in order to draw attention and notify dangers. For example, the specifier 102 specifies an emphasis part from input text data. When information for specifying an emphasis part is added to input text data in advance, the specifier 102 can specify the emphasis part by referring to the added information (additional information). The specifier 102 may specify the emphasis part by collating the text data with data indicating a predetermined emphasis part. The specifier 102 may execute both of the specification by the additional information and the specification by the data collation. Data indicating an emphasis part may be stored in the storage 121, or may be stored in a storage device outside the speech processing apparatus 100.

The specifier 102 may execute encoding processing for adding information (additional information) to the text data, the information indicating that the specified emphasis part is emphasized. The subsequent modulator 103 can determine the emphasis part to be modulated by referring to the thus added additional information. The additional information may be in any form as long as an emphasis part can be determined with the information. The specifier 102 may store the encoded text data in a storage medium, such as the storage 121. Consequently, text data that is added with additional information in advance can be used in subsequent speech output processing.

The modulator 103 modulates at least one of the pitch and the phase of speech to be output as the modulation target. For example, the modulator 103 modulates a modulation target of an emphasis part of at least one of speech (first speech) to be output to the speaker 105-1 and speech (second speech) to be output to the speaker 105-2 such that the modulation target of the emphasis part of the first speech and the modulation target of the emphasis part of the second speech are different.

In the first embodiment, when generating speeches converted from text data, the modulator 103 sequentially determines whether the text data is an emphasis part, and executes modulation processing on the emphasis part. Specifically, in the case of converting text data to generate speech (first speech) to be output to the speaker 105-1 and speech (second speech) to be output to the speaker 105-2, the modulator 103 generates the first speech and the second speech in which a modulation target of at least one of the first speech and the second speech is modulated such that modulation targets are different from each other for text data of the emphasis part.

The processing of converting text data into speech (speech synthesis processing) may be implemented by using any conventional method such as formant speech synthesis and speech corpus-based speech synthesis.

For the modulation of the phase, the modulator 103 may reverse the polarity of a signal input to one of the speaker 105-1 and the speaker 105-2. In this manner, one of the speakers 105 is in antiphase to the other, and the same function as that when the phase of speech data is modulated can be implemented.

The modulator 103 may check the integrity of data to be processed, and perform the modulation processing when the integrity is confirmed. For example, when additional information added to text data is in a form that designates information indicating the start of an emphasis part and information indicating the end of the emphasis part, the modulator 103 may perform the modulation processing when it can be confirmed that the information indicating the start and the information indicating the end correspond to each other.

The output controller 104 controls the output of speech from the speakers 105. For example, the output controller 104 controls the speaker 105-1 to output first speech the modulation target of which has been modulated, and controls the speaker 105-2 to output second speech. When the speakers 105 other than the speaker 105-1 and the speaker 105-2 are installed, the output controller 104 allocates optimum speech to each speaker 105 to be output. Each speaker 105 outputs speech on the basis of output data from the output controller 104.

The output controller 104 uses parameters such as the position and characteristics of the speaker 105 to calculate the output (amplifier output) to each speaker 105. The parameters are stored in, for example, the storage 121.

For example, in the case of matching required sound pressures for two speakers 105, amplifier outputs W1 and W2 for the respective speakers are calculated as follows. Distances associated with the two speakers are represented by L1 and L2. For example, L1 (L2) is the distance between the speaker 105-1 (speaker 105-2) and the center of the head of a user. The distance between each speaker 105 and the closest ear may be used. The gain of the speaker 105-1 (speaker 105-2) in an audible region of speech in use is represented by Gs1 (Gs2). The gain reduces by 6 dB when the distance is doubled, and the amplifier output needs to be doubled for an increase in sound pressure of 3 dB. In order to match the sound pressures between both ears, the output controller 104 calculates and determines the amplifier outputs W1 and W2 so as to satisfy the following equation:

$$-6\times(L1/L2)\times(1/2)+(2/3)\times Gs1\times W1=-6\times(L2/L1)\times(1/2)+(2/3)\times Gs2\times W2$$

The receptor 101, the specifier 102, the modulator 103, and the output controller 104 may be implemented by, for example, causing one or more processors such as central processing units (CPUs) to execute programs, that is, by software, may be implemented by one or more processors such as integrated circuits (ICs), that is, by hardware, or may be implemented by a combination of software and hardware.

Figure 2:
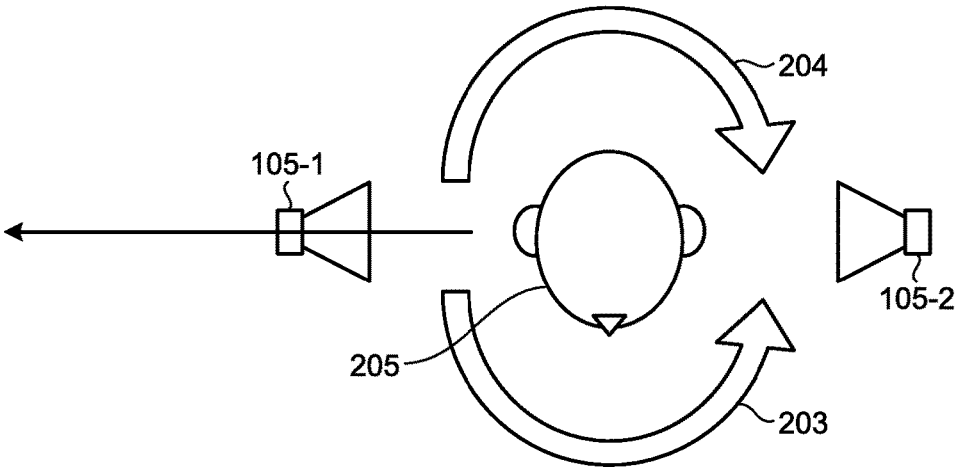
FIG. 2 is a diagram illustrating an example of arrangement of speakers in embodiments.

FIG. 2 is a diagram illustrating an example of the arrangement of speakers 105 in the first embodiment. FIG. 2 illustrates an example of the arrangement of speakers 105 as observed from above a user 205 to below in the vertical direction. Speeches that have been subjected to the modulation processing by the modulator 103 are output from a speaker 105-1 and a speaker 105-2. The speaker 105-1 is placed on an extension line from the right ear of the user 205. The speaker 105-2 can be placed an angle with respect to a line passing through the speaker 105-1 and the right ear.

The inventor measured attention obtained when speech the pitch and phase of which are modulated is output while the position of the speaker 105-2 is changed along a curve 203 or a curve 204, and confirmed an increase of the attention in each case. The attention was measured by using evaluation criterion such as electroencephalogram (EEG), near-infrared spectroscopy (NIRS), and subjective evaluation.

Figure 3:
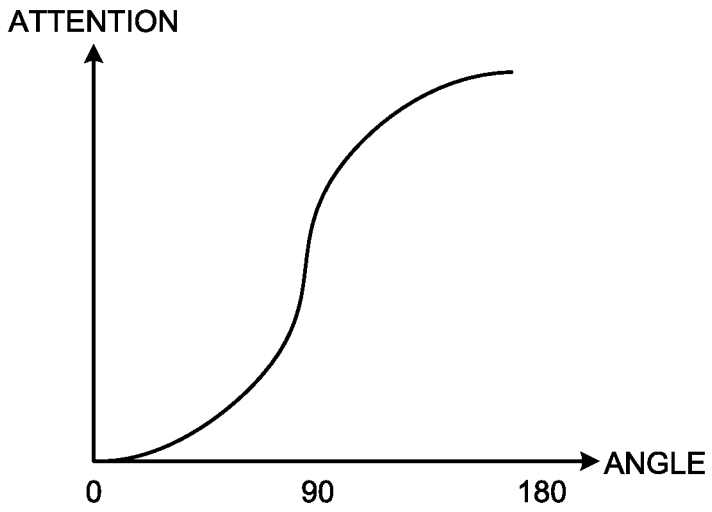
FIG. 3 is a diagram illustrating an example of measurement results.

FIG. 3 is a diagram illustrating an example of measurement results. The horizontal axis of the graph in FIG. 3 represents an arrangement angle of the speakers 105. For example, the arrangement angle is an angle formed by a line connecting the speaker 105-1 and the user 205 and a line connecting the speaker 105-2 and the user 205. As illustrated in FIG. 3, the attention increases greatly when the arrangement angle is from 90° to 180°. It is therefore desired that the speaker 105-1 and the speaker 105-2 be arranged to have an arrangement angle of from 90° to 180°. Note that the arrangement angle may be smaller than 90° as long as the arrangement angle is larger than 0° because the attention is detected.

The pitch or phase in the whole section of speech may be modulated, but in this case, attention can be reduced because of being accustomed. Thus, the modulator 103 modulates only an emphasis part specified by, for example, additional information. Consequently, attention to the emphasis part can be effectively enhanced.

Figure 4:
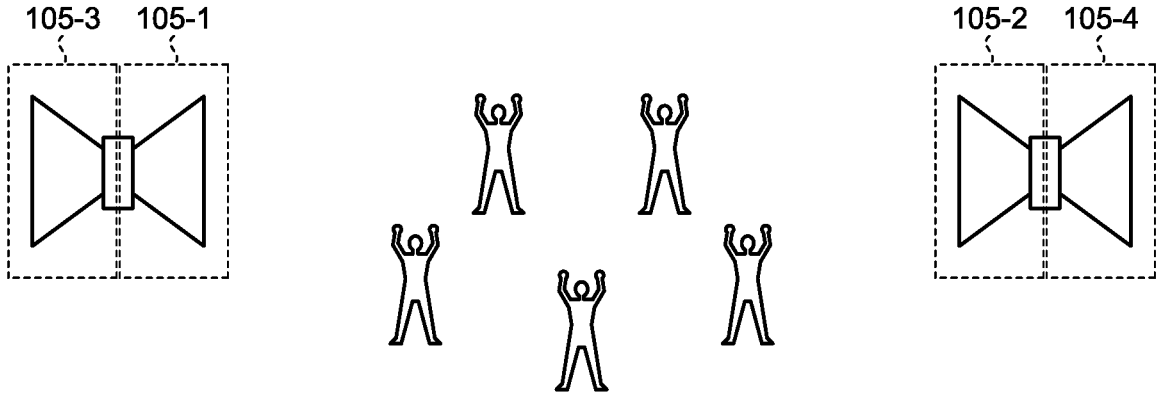
FIG. 4 is a diagram illustrating another example of the arrangement of the speakers in the embodiments.

FIG. 4 is a diagram illustrating another example of the arrangement of speakers 105 in the first embodiment. FIG. 4 illustrates an example of the arrangement of speakers 105 that are installed to output outdoor broadcasting outdoors. As illustrated in FIG. 3, it is desired to use a pair of speakers 105 having an arrangement angle of from 90° to 180°. Thus, in the example in FIG. 4, the modulation processing of speech is executed for a pair of a speaker 105-1 and a speaker 105-2 arranged at an arrangement angle of 180°.

Figure 5:
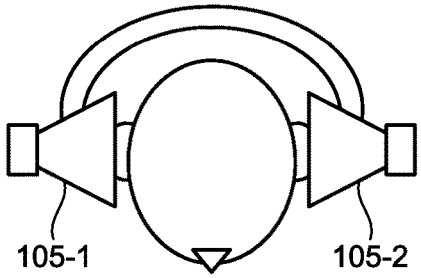
FIG. 5 is a diagram illustrating another example of the arrangement of the speakers in the embodiments.

FIG. 5 is a diagram illustrating another example of the arrangement of speakers 105 in the first embodiment. FIG. 5 is an example where the speaker 105-1 and the speaker 105-2 are configured as headphones.

The arrangement examples of the speakers 105 are not limited to FIG. 2, FIG. 4, and FIG. 5. Any combination of speakers can be employed as long as the speakers are arranged at an arrangement angle that obtains attention as illustrated in FIG. 3. For example, the first embodiment may be applied to a plurality of speakers used for a car navigation system.

Figure 6:
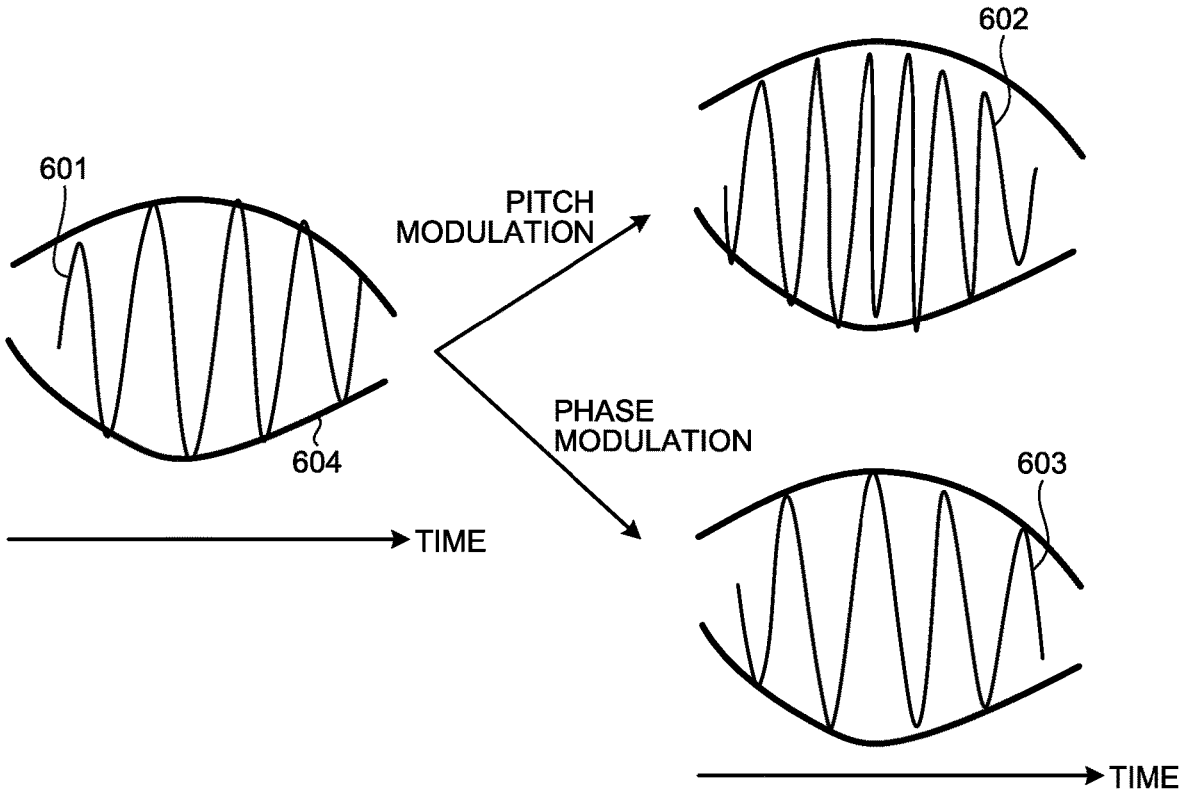
FIG. 6 is a diagram for describing pitch modulation and phase modulation.

Next, pitch modulation and phase modulation are described. FIG. 6 is a diagram for describing the pitch modulation and the phase modulation. The phase modulation involves outputting a signal 603 obtained by changing, on the basis of an envelope 604 of speech, temporal positions of peaks in its original signal 601 without changing the wavenumber in a unit time with respect to the same envelope. The pitch modulation involves outputting a signal 602 obtained by changing the wavenumber.

Figure 7:
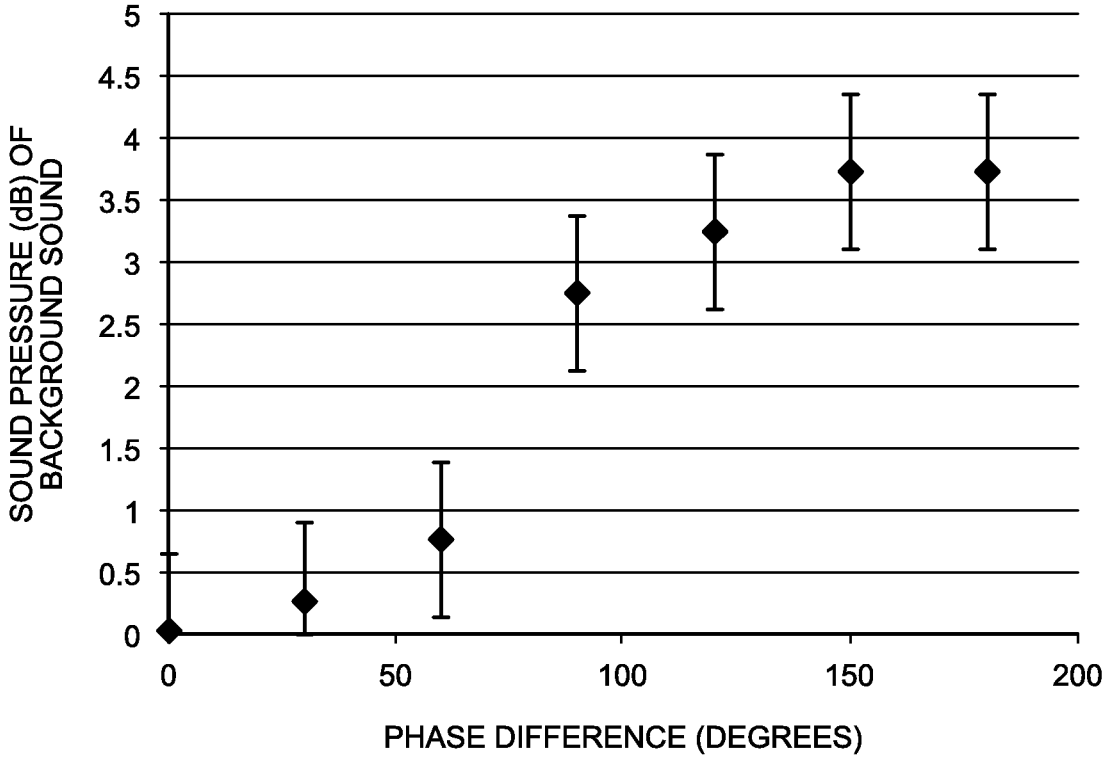
FIG. 7 is a diagram illustrating a relation between a phase difference (degrees) and a sound pressure (dB) of background sound.

Next, the relation between the pitch or phase modulation and the audibility of speech is described. FIG. 7 is a diagram illustrating a relation between a phase difference (degrees) and a sound pressure (dB) of background sound. The phase difference represents a difference in phase between speeches output from two speakers 105 (for example, a difference between the phase of the speech output from the speaker 105-1 and the phase of the speech output from the speaker 105-2). The sound pressure of background sound represents a maximum value of sound pressure (sound pressure limit) of background sound with which the user can hear output speech.

The background sound is sound other than speeches output from the speakers 105. For example, the background sound corresponds to ambient noise, sound such as music being output other than speeches, and the like. Points indicated by rectangles in FIG. 7 each represent an average value of obtained values. The range indicated by the vertical line on each point represents a standard deviation of the obtained values.

As illustrated in FIG. 7, even when background sound of 0.5 dB or more is present, the user can hear speeches output from the speaker 105 as long as the phase difference is 60° or more and 180° or less. Thus, the modulator 103 may execute the modulation processing such that the phase difference is 60° or more and 180° or less. The modulator 103 may execute the modulation processing so as to obtain a phase difference of 90° or more and 180° or less, or 120° or more and 180° or less, with which the sound pressure limit is higher.

Figure 8:
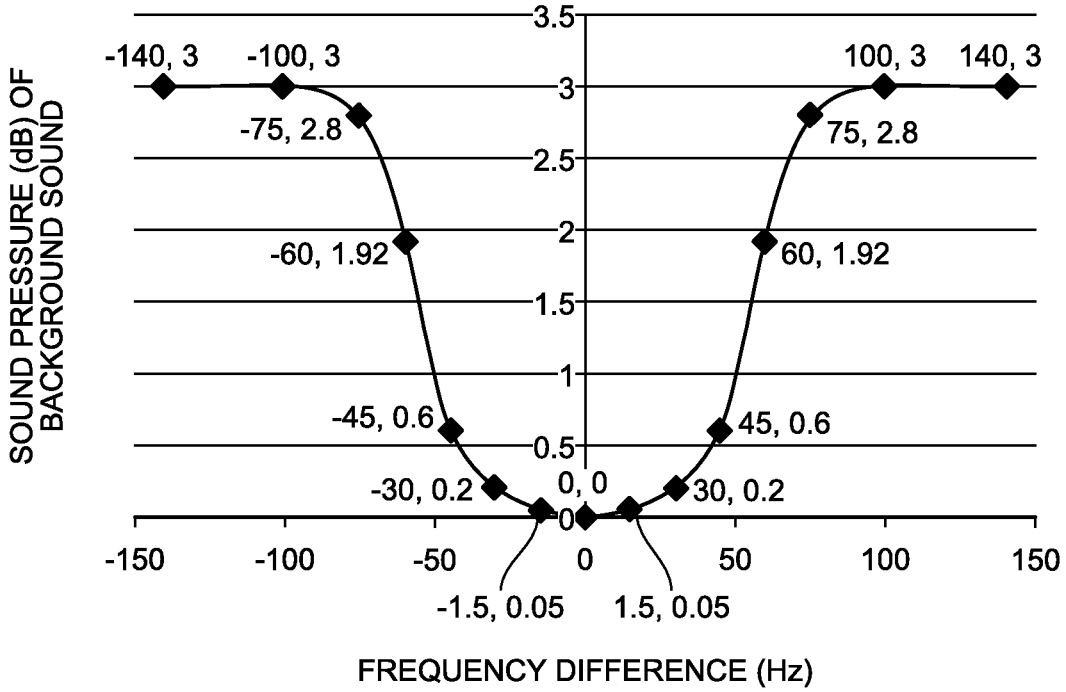
FIG. 8 is a diagram illustrating a relation between a frequency difference (Hz) and a sound pressure (dB) of background sound.

FIG. 8 is a diagram illustrating a relation between a frequency difference (Hz) and the sound pressure (dB) of background sound. The frequency difference represents a difference in frequency between speeches output from two speakers 105 (for example, a difference between the frequency of a speech output from the speaker 105-1 and the frequency of a speech output from the speaker 105-2). Points indicated by rectangles in FIG. 8 each represent an average value of obtained values. Of numerical values "A, B" attached to the side of the points, "A" represents the frequency difference, and "B" represents the sound pressure of background sound.

As illustrated in FIG. 8, even when background sound is present, the user can hear speeches output from the speakers 105 as long as the frequency difference is 100 Hz (hertz) or more. Thus, the modulator 103 may execute the modulation processing such that the frequency difference is 100 Hz or more in the audible range.

Figure 9:
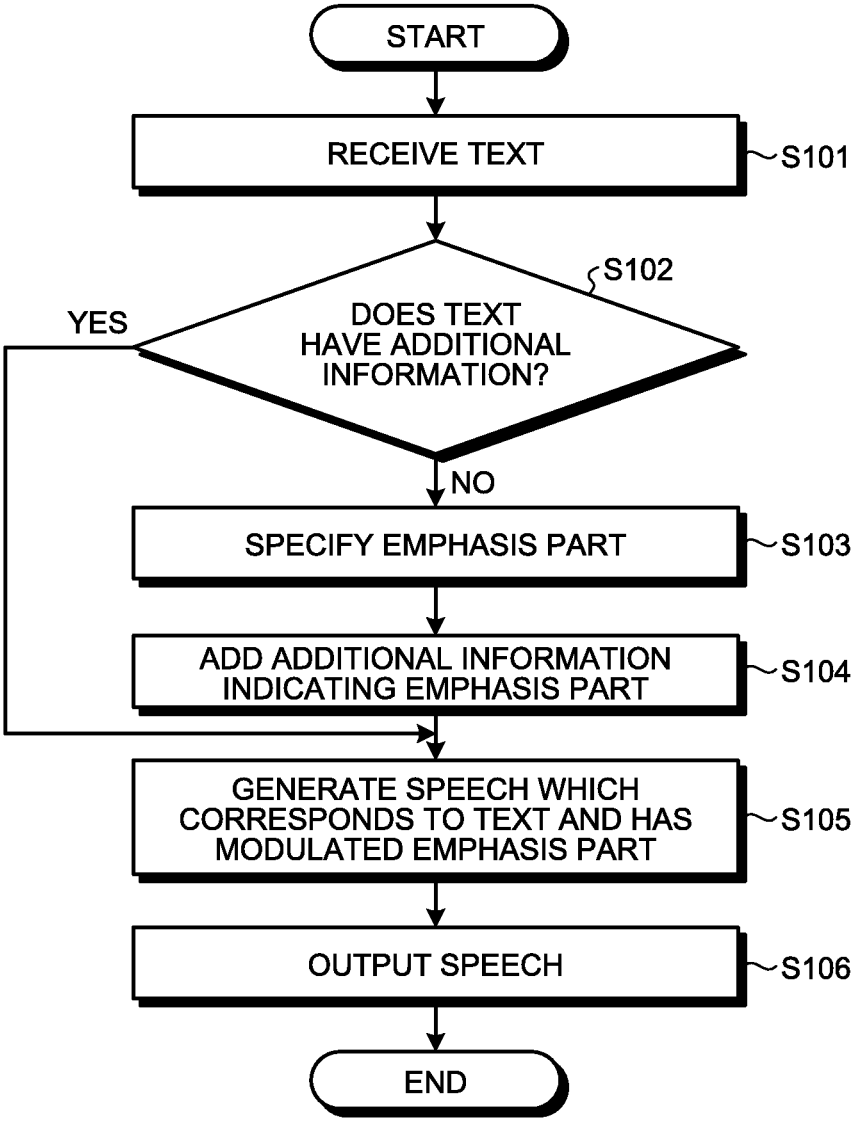
FIG. 9 is a flowchart of the speech output processing according to the first embodiment.

Next, the speech output processing by the speech processing apparatus 100 according to the first embodiment configured as described above is described with reference to FIG. 9. FIG. 9 is a flowchart illustrating an example of the speech output processing in the first embodiment.

The receptor 101 receives an input of text data (Step S101). The specifier 102 determines whether additional information is added to the text data (Step S102). When additional information is not added to the text data (No at Step S102), the specifier 102 specifies an emphasis part from the text data (Step S103). For example, the specifier 102 specifies an emphasis part by collating the input text data with data indicating a predetermined emphasis part. The specifier 102 adds additional information indicating the emphasis part to a corresponding emphasis part of the text data (Step S104). Any method of adding the additional information can be employed as long as the modulator 103 can specify the emphasis part.

After the additional information is added (Step S104) or when additional information has been added to the text data (Yes at Step S102), the modulator 103 generates speeches (first speech and second speech) corresponding to the text data, the modulation targets of which are modulated such that the modulation targets are different for text data for the emphasis part (Step S105).

The output controller 104 determines a speech to be output for each speaker 105 so as to output the determined speech (Step S106). Each speaker 105 outputs the speech in accordance with the instruction from the output controller 104.

In this manner, the speech processing apparatus according to the first embodiment is configured to modulate, while generating the speech corresponding to text data, at least one of the pitch and the phase of speech for text data corresponding to an emphasis part, and output the modulated speech. Consequently, users' attention can be enhanced without changing the intensity of speech signals.

Second Embodiment

In the first embodiment, when text data are sequentially converted into speech, the modulation processing is performed on text data on an emphasis part. A speech processing apparatus according to a second embodiment is configured to generate speech for text data and thereafter perform the modulation processing on the speech corresponding to an emphasis part of the generated speech.

Figure 10:
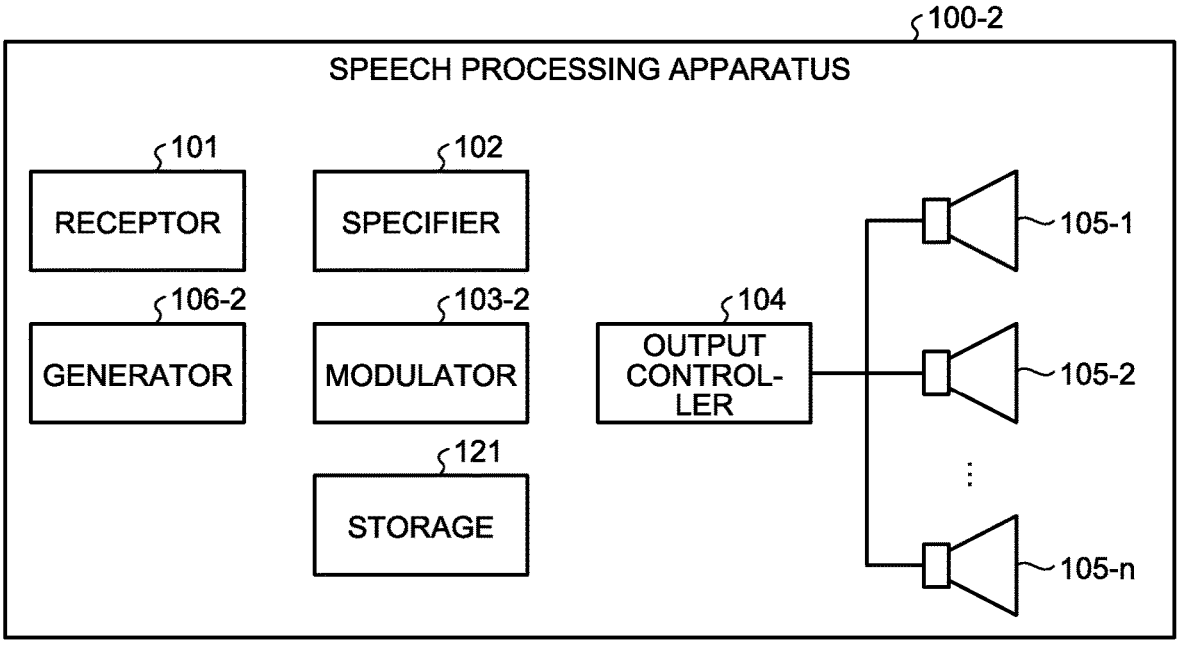
FIG. 10 is a block diagram of a speech processing apparatus according to a second embodiment.

FIG. 10 is a block diagram illustrating an example of a configuration of a speech processing apparatus 100-2 according to the second embodiment. As illustrated in FIG. 10, the speech processing apparatus 100-2 includes a storage 121, a receptor 101, a specifier 102, a modulator 103-2, an output controller 104, the speakers 105-1 to **105-*n*, and a generator 106-2**.

The second embodiment differs from the first embodiment in that the function of the modulator 103-2 and the generator 106-2 are added. Other configurations and functions are the same as those in FIG. 1, which is a block diagram of the speech processing apparatus 100 according to the first embodiment, and are therefore denoted by the same reference symbols to omit descriptions thereof.

The generator 106-2 generates the speech corresponding to text data. For example, the generator 106-2 converts the input text data into the speech (first speech) to be output to the speaker 105-1 and the speech (second speech) to be output to the speaker 105-2.

The modulator 103-2 performs the modulation processing on an emphasis part of the speech generated by the generator 106-2. For example, the modulator 103-2 modulates a modulation target of an emphasis part of at least one of the first speech and the second speech such that modulation targets are different between an emphasis part of the generated first speech and an emphasis part of the generated second speech.

Figure 11:
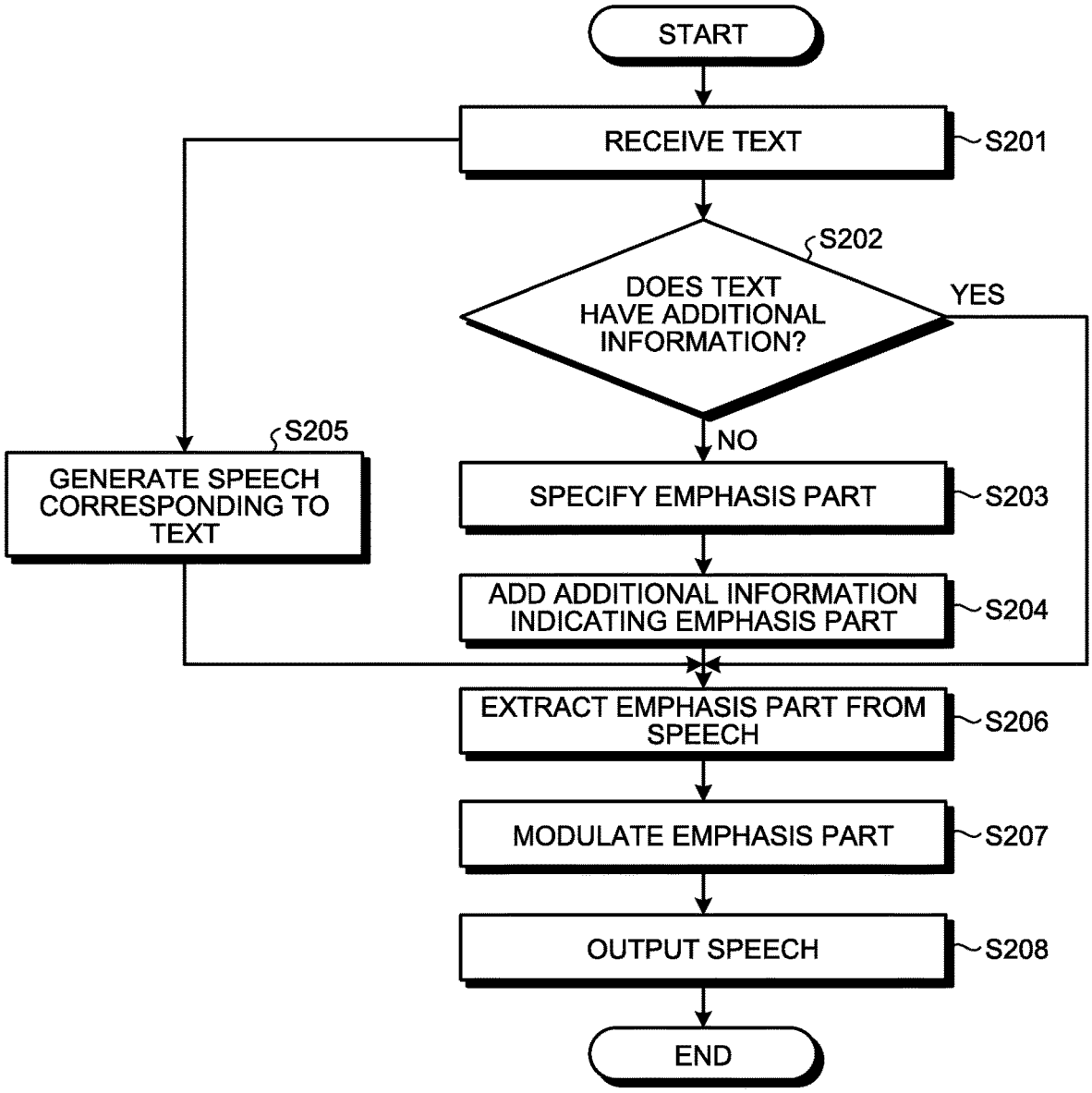
FIG. 11 is a flowchart of the speech output processing according to the second embodiment.

Next, the speech output processing by the speech processing apparatus 100-2 according to the second embodiment configured as described above is described with reference to FIG. 11. FIG. 11 is a flowchart illustrating an example of the speech output processing in the second embodiment.

Step S201 to Step S204 are processing similar to those at Step S101 to Step S104 in the speech processing apparatus 100 according to the first embodiment, and hence descriptions thereof are omitted.

In the second embodiment, when text data is input, speech generation processing (speech synthesis processing) is executed by the generator 106-2. Specifically, the generator 106-2 generates the speech corresponding to the text data (Step S205).

After the speech is generated (Step S205), after additional information is added (Step S204), or when additional information has been added to text data (Yes at Step S202), the modulator 103-2 extracts an emphasis part from the generated speech (Step S206). For example, the modulator 103-2 refers to the additional information to specify an emphasis part in the text data, and extracts an emphasis part of the speech corresponding to the specified emphasis part of the text data on the basis of the correspondence between the text data and the generated speech. The modulator 103-2 executes the modulation processing on the extracted emphasis part of the speech (Step S207). Note that the modulator 103-2 does not execute the modulation processing on the parts of the speech excluding the emphasis part.

Step S208 is processing similar to that at Step S106 in the speech processing apparatus 100 according to the first embodiment, and hence a description thereof is omitted.

In this manner, the speech processing apparatus according to the second embodiment is configured to, after generating the speech corresponding to text data, modulate at least one of the pitch and phase of the emphasis part of the speech, and output the modulated speech. Consequently, users' attention can be enhanced without changing the intensity of speech signals.

Third Embodiment

In the first and second embodiments, text data is input, and the input text data is converted into a speech to be output. These embodiments can be applied to, for example, the case where predetermined text data for emergency broadcasting is output. Another conceivable situation is that speech uttered by a user is output for emergency broadcasting. A speech processing apparatus according to a third embodiment is configured such that speech is input from a speech input device, such as a microphone, and an emphasis part of the input speech is subjected to the modulation processing.

Figure 12:
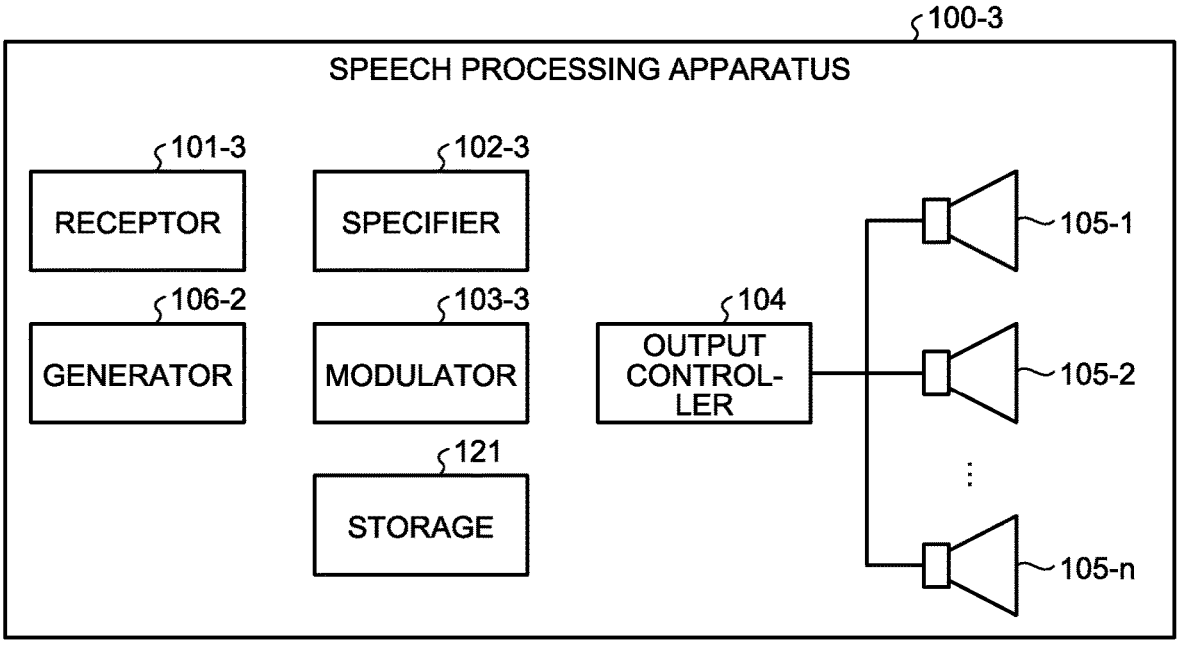
FIG. 12 is a block diagram of a speech processing apparatus according to a third embodiment.

FIG. 12 is a block diagram illustrating an example of a configuration of a speech processing apparatus 100-3 according to the third embodiment. As illustrated in FIG. 12, the speech processing apparatus 100-3 includes a storage 121, a receptor 101-3, a specifier 102-3, a modulator 103-3, an output controller 104, the speakers 105-1 to **105-*n*, and a generator 106-2**.

The third embodiment differs from the second embodiment in functions of the receptor 101-3, the specifier 102-3, and the modulator 103-3. Other configurations and functions are the same as those in FIG. 10, which is a block diagram of the speech processing apparatus 100-2 according to the second embodiment, and are therefore denoted by the same reference symbols and descriptions thereof are omitted.

The receptor 101-3 receives not only text data but also a speech input from a speech input device, such as a microphone. Furthermore, the receptor 101-3 receives a designation of a part of the input speech to be emphasized. For example, the receptor 101-3 receives a depression of a predetermined button by a user as a designation indicating that a speech input after the depression is a part to be emphasized. The receptor 101-3 may receive designations of start and end of an emphasis part as a designation indicating that a speech input from the start to the end is a part to be emphasized. The designation methods are not limited thereto, and any method can be employed as long as a part to be emphasized in a speech can be determined. The designation of a part of a speech to be emphasized is hereinafter sometimes referred to as "trigger".

The specifier 102-3 further has the function of specifying an emphasis part of a speech on the basis of a received designation (trigger).

The modulator 103-3 performs the modulation processing on an emphasis part of a speech generated by the generator 106-2 or of an input speech.

Figure 13:
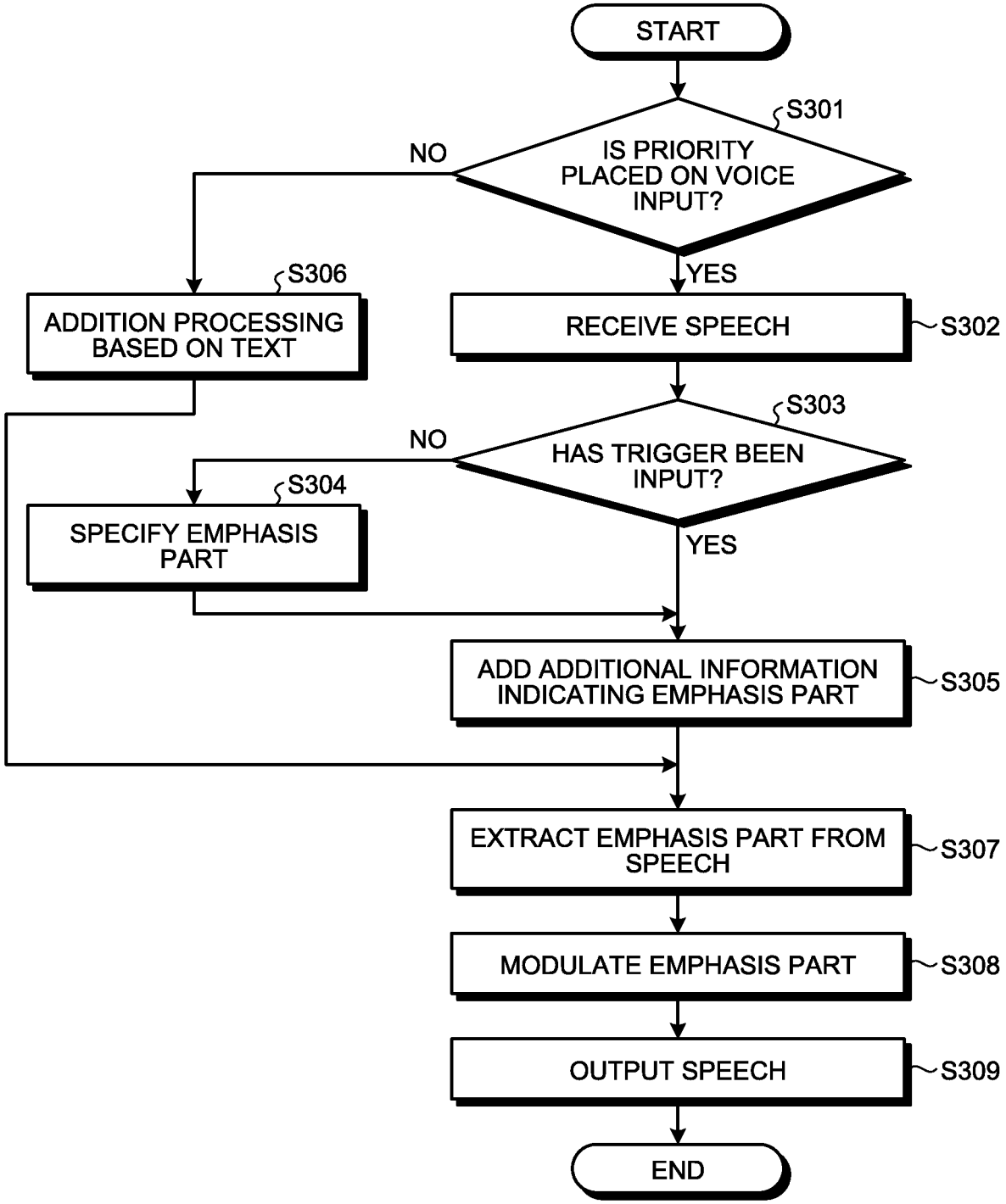
FIG. 13 is a flowchart of the speech output processing according to the third embodiment.

Next, the speech output processing by the speech processing apparatus 100-3 according to the third embodiment configured as described above is described with reference to FIG. 13. FIG. 13 is a flowchart illustrating an example of the speech output processing in the third embodiment.

The receptor 101-3 determines whether priority is placed on speech input (Step S301). Placing priority on speech input is a designation indicating that speech is input and output instead of text data. For example, the receptor 101-3 determines that priority is placed on speech input when a button for designating that priority is placed on speech input has been depressed.

The method of determining whether priority is placed on speech input is not limited thereto. For example, the receptor 101-3 may determine whether priority is placed on speech input by referring to information stored in advance that indicates whether priority is placed on speech input. In the case where no text data is input and only speech is input, a designation and a determination as to whether priority is placed on speech input (Step S301) are not required to be executed. In this case, addition processing (Step S306) based on the text data described later is not necessarily required to be executed.

When priority is placed on speech input (Yes at Step S301), the receptor 101-3 receives an input of speech (Step S302). The specifier 102-3 determines whether a designation (trigger) of a part of the speech to be emphasized has been input (Step S303).

When no trigger has been input (No at Step S303), the specifier 102-3 specifies the emphasis part of the speech (Step S304). For example, the specifier 102-3 collates the input speech with speech data registered in advance, and specifies speech that matches or is similar to the registered speech data as the emphasis part. The specifier 102-3 may specify the emphasis part by collating text data obtained by speech recognition of input speech and data representing a predetermined emphasis part.

When it is determined at Step S303 that a trigger has been input (Yes at Step S303) or after the emphasis part is specified at Step S304, the specifier 102-3 adds additional information indicating the emphasis part to data on the input speech (Step S305). Any method of adding the additional information can be employed as long as speech can be determined to be an emphasis part.

When it is determined at Step S301 that no priority is placed on speech input (No at Step S301), the addition processing based on text is executed (Step S306). This processing can be implemented by, for example, processing similar to Step S201 to Step S205 in FIG. 11.

The modulator 103-3 extracts the emphasis part from the generated speech (Step S307). For example, the modulator 103-3 refers to the additional information to extract the emphasis part of the speech. When Step S306 has been executed, the modulator 103-3 extracts the emphasis part by processing similar to Step S206 in FIG. 11.

Step S308 and Step S309 are processing similar to Step S207 and Step S208 in the speech processing apparatus 100-2 according to the second embodiment, and hence descriptions thereof are omitted.

In this manner, the speech processing apparatus according to the third embodiment is configured to specify an emphasis part of input speech by a trigger or the like, modulate at least one of the pitch and phase of the emphasis part of the speech, and output the modulated speech. Consequently, users' attention can be enhanced without changing the intensity of speech signals.

Fourth Embodiment

In the embodiments described above, the emphasis part is specified by, for example, referring to the additional information and the trigger. The specifying method of the emphasis part is not limited to this. A speech processing apparatus according to the fourth embodiment specifies any one or more partial speeches in the speech (partial speech) included in the speech to be output, as the emphasis part based on an attribute of the partial speech.

Following describes an example of achievement of the speech processing apparatus as an application for learning by a speech, or an application in which text data is output as a speech. Learning by a speech includes, for example, any learning using a speech such as learning of a foreign language by a speech and learning in which a content of a subject is output by a speech. Applications in which text data is output as a speech include, for example, a reading application in which a content of a book is read and output by a speech. Applicable applications are not limited to these.

Applying to the application for learning by the speech can, for example, suitably emphasize a portion to be a learning target and further increase the learning effect. Applying to the application in which the text data is output as the speech can, for example, direct attention of a user to a specified portion of the speech. Applying to the reading application can, for example, further increase a sense of realism of a story.

Figure 14:
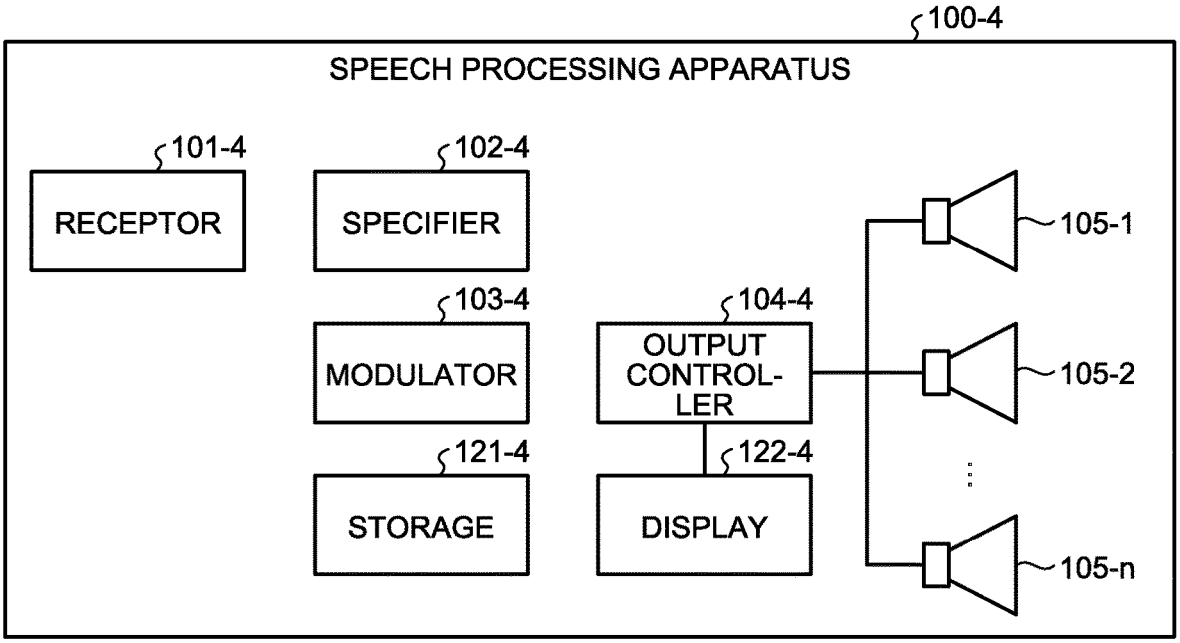
FIG. 14 is a block diagram of a speech processing apparatus according to a fourth embodiment.

FIG. 14 is a block diagram illustrating an example of a configuration of a speech processing apparatus 100-4 according to a fourth embodiment. As illustrated in FIG. 14, the speech processing apparatus 100-4 includes a storage 121-4, a display 122-4, a receptor 101-4, a specifier 102-4, a modulator 103-4, an output controller 104-4, and speakers 105-1 to **105-*n*. The speakers 105-1 to 105-*n* are similar to that in FIG. 1 that is a block diagram of the speech processing apparatus 100** according to the first embodiment. Thus, identical reference numerals are added and description thereof will be omitted.

Figures 15, 16:
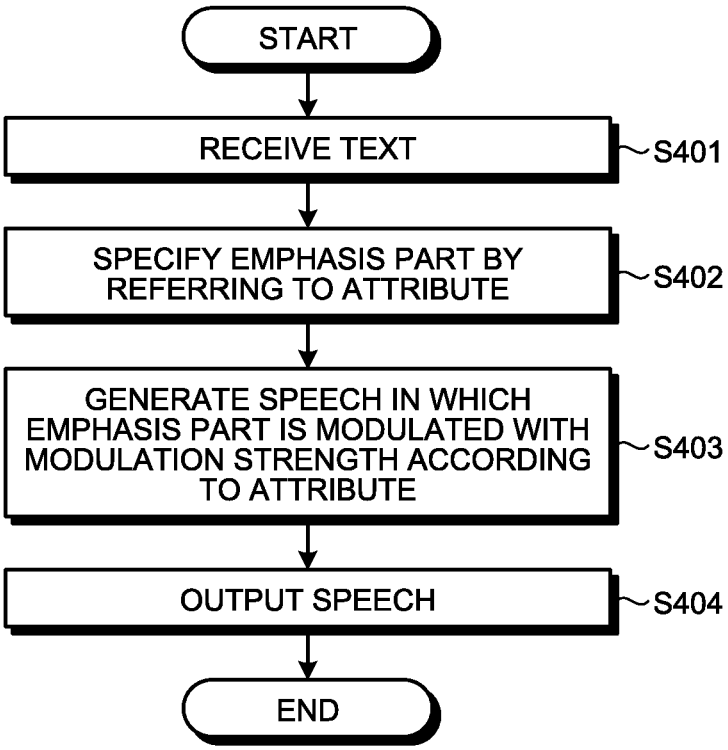
FIG. 15 is a diagram illustrating an example of a structure of data stored in a storage.
FIG. 16 is a flowchart of speech output processing in the fourth embodiment.

The storage 121-4 is different from the storage 121 of the first embodiment in further storing the number of outputs as an example of an attribute of the partial speech included in the speech to be output. FIG. 15 is a diagram illustrating an example of structure of data to be stored in the storage 121-4. FIG. 15 illustrates an example of data structure of data indicating the partial speech to be a learning target. As illustrated in FIG. 15, this data includes a speech ID, a word, time, and the number of outputs.

The speech ID is identification information that identifies the speech to be an output target. For example, a numerical value, a file name of a file in which the speech is stored, or the like may be the speech ID.

The word is an example of the learning target. Other information may be the learning target. For example, a target other than words in a sentence or a chapter including a plurality of words may be used with the words or may be used instead of the words. The words to be stored in the storage 121-4 may be a part of words selected by the user or the like from all words included in the speech and may be all words included in the speech. An example of the selection method of the words will be described later.

The time indicates a position of the partial speech corresponding to the words in the speech. Information other than the time may be stored if it is information with which the position of the partial speech can be specified.

The word and time are, for example, acquired by speech recognition of the speech used for learning. The speech processing apparatus 100-4 may acquire data such as that in FIG. 15 generated by the other apparatus beforehand and store the data in the storage 121-4. The speech processing apparatus 100-4 may store the data acquired by performing speech recognition to the acquired speech, in the storage 121-4.

The number of outputs indicates the number of outputs of the partial speech corresponding to the word. For example, the cumulative value of the number of outputs of the partial speech from the start of learning is stored in the storage 121-4 as the number of outputs. The number of outputs is an example of the attribute of the partial speech. Information other than the number of outputs may be used as the attribute of the partial speech. Another example of the attribute will be described later.

Referring back to FIG. 14, the display 122-4 is a display device that displays data used for various types of processing. The display 122-4 can be configured, for example, by a liquid crystal display.

The receptor 101-4 is different from the receptor 101 of the first embodiment in further receiving designation of the words to be the learning target.

The specifier 102-4 specifies any one or more of partial speech of one or more partial speeches included in the speech as the emphasis part based on the attribute of the partial speech. When, for example, the number of outputs is the attribute, the specifier 102-4 specifies the partial speech of which the number of outputs is equal to or less than a threshold, as the emphasis part. Thereby, for example, the word that is considered to be insufficient in learning for its small number of outputs, is emphasized preferentially, and learning effect can be further increased. Even when the output time of the speech (for example, cumulative output time from the start of learning) is used instead of the number of outputs as the attribute, similar effect can be acquired.

The modulator 103-4 is different from the modulator 103 of the first embodiment in changing the degree of modulation (modulation strength) of the emphasis part based on the attribute. The modulator 103-4, for example, modulates at least one of the first speech and the second speech so that the partial speech having smaller number of outputs is modulated with larger modulation strength. The modulation strength may be changed to a linear shape or non-linear shape depending on the number of outputs. The modulator 103-4 may make the modulation strength of each part included in the emphasis part to be different from each other. For example, the modulation strength may be controlled so as to emphasize only an accent part of the word. The modulator 103-4 may be configured not to change the modulation strength based on the attribute. In this case, the modulator 103 that is similar to that of the first embodiment may be included.

The output controller 104-4 is different from the output controller 104 of the first embodiment in further including a function of controlling output (display) of various types of data to the display 122-4.

Next, speech output processing by the speech processing apparatus 100-4 according to the fourth embodiment configured as above will be described with reference to FIG. 16. FIG. 16 is a flowchart illustrating an example of the speech output processing in the fourth embodiment.

The receptor 101-4 receives input of the text data (step S401). The specifier 102-4 specifies the emphasis part by referring to the attribute from the text data (step S402). When, for example, the number of outputs is the attribute, the specifier 102-4 specifies the word having the number of outputs stored in the storage 121-4 is equal to or less than a threshold as the emphasis part.

The modulator 103-4 generates the speech in which the specified emphasis part is modulated (step S403). For example, the modulator 103-4 generates the speeches (first speech and second speech) that corresponds to the specified emphasis part (word or the like) and in which the modulation target is modulated so that the modulation targets in the emphasis part are different from each other. At this time, the modulator 103-4 may generate the first speech and the second speech to have the modulation strength according to the attribute.

The output controller 104-4 determines the speech to be output for each of the speakers 105 and makes the speakers 105 to output the determined speech (step S404). Each of the speakers 105 outputs the speech according to the instruction of the output controller 104-4.

Next, an example of a case where the speech processing apparatus 100-4 is achieved as an application for language learning will be described. A learning application has, for example, following functions.

(1) Function of designating a place to be a learning target, that is, the emphasis part in the speech to be output.

(2) Function of playing back the speech. This function may include functions such as pausing, rewinding, and fast-forwarding.

(3) Function of confirming whether the emphasis part is understood.

(4) Function of changing the attribute according to a learning result or the like.

Figure 17:
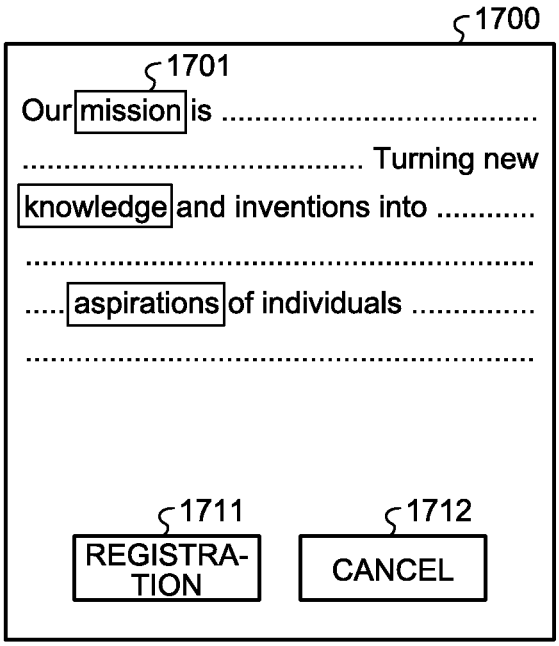
FIG. 17 is a diagram illustrating an example of a designation screen for designating a part to be a target of learning.

FIG. 17 is a diagram illustrating an example of a designation screen for designating the place to be the learning target. As illustrated in FIG. 17, the designation screen 1700 is a screen that displays the text data corresponding to the speech to be output. The designation screen 1700 is displayed, for example, on the display 122-4 by the output controller 104-4. The designation screen 1700 is an example of the screen that achieves the function (1) described above.

The user selects the place to be the learning target (word, sentence, etc.) from the text data displayed on the designation screen 1700, by a mouse, touch panel, or the like. A word 1701 represents an example of the place selected in this way.

When a registration button 1711 is depressed, selected word is stored in the storage 121-4 as the learning target. FIG. 15 illustrates an example of data stored in this way. In FIG. 15, the number of outputs is set to, for example, "0" at a time of registration. When a cancel button 1712 is depressed, for example, a selected state is released and the former screen is displayed.

The designation method of the learning target is not limited to the method illustrated in FIG. 17. For example, when registration (depressing of button, etc.) is instructed during the output of the speech, the place (word, etc.) in which the output is performed at the timing of the instruction may be registered as the learning target. Data illustrated in FIG. 15 may be generated by selecting one or more words to be the learning targets independent of the speech, and extracting the selected words from the speech (or text data corresponding to the speech).

It is required before the start of the learning that the place to be the learning target is designated by the method illustrated in FIG. 17 or the like and the data as illustrated in FIG. 15 is generated. Following describes an example of the screen used in learning.

Figure 18:
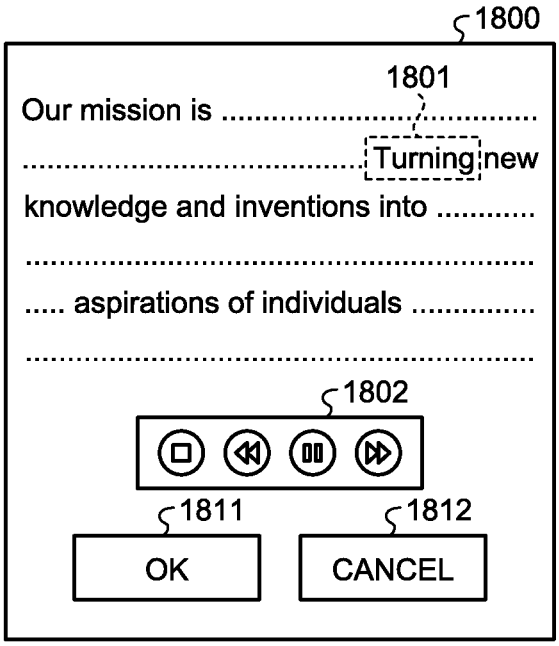
FIG. 18 is a diagram illustrating an example of a learning screen.

FIG. 18 is a diagram illustrating an example of a learning screen. As illustrated in FIG. 18, a learning screen 1800 includes a cursor 1801, an output control button 1802, an OK button 1811, and a cancel button 1812.

The output control button 1802 is used for starting the playback of the speech, pausing, stopping of the playback, rewinding, and fast-forwarding. The cursor 1801 is information for indicating a place corresponding to the speech that is being played back now. In FIG. 18, an example of the cursor 1801 having a rectangular shape is illustrated. However, the display mode of the cursor 1801 is not limited to this.

When the OK button 1811 is depressed, the learning processing ends. When the OK button 1811 is depressed, data of the storage 121-4 may be updated by adding 1 to the number of outputs of each word that has been played back until then. For example, when playing back of a word is repeated by the rewinding function, the number of outputs of this word increases. When, for example, the number of outputs of the word that has been played back repeatedly exceeds a threshold, the specifier 102-4 does not specify this word as the emphasis part and specifies only the word having the number of outputs that is equal to or less than a threshold as the emphasis part. Thereby, the word to be the learning target is specified suitably and learning effect can be increased.

When the cancel button 1812 is depressed, for example, former screen is displayed. It may be configured so that the number of outputs is not updated when the cancel button 1812 is depressed.

Figure 19:
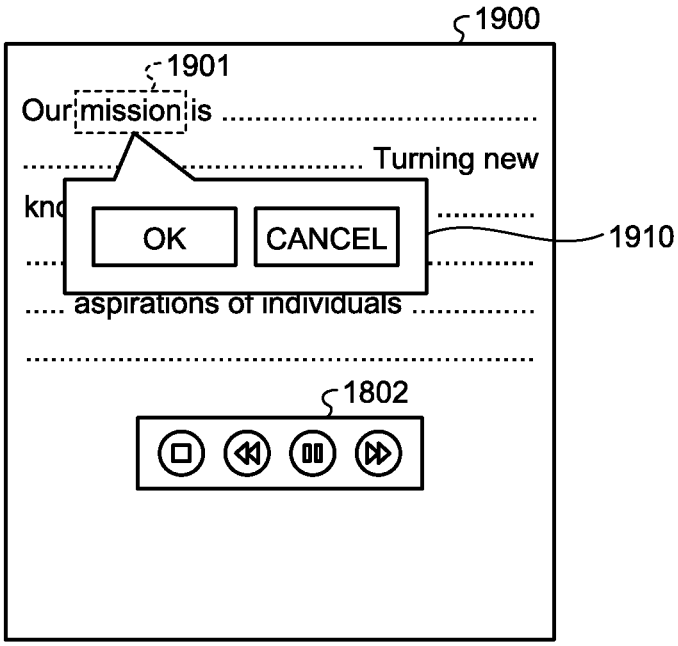
FIG. 19 is a diagram illustrating another example of the learning screen.

FIG. 19 is a diagram illustrating another example of the learning screen. The learning screen 1900 in FIG. 19 is an example of the screen in which a learning result can be designated for each word. The cursor 1901 is displayed to the word corresponding to the speech that is being played back and a designation window 1910 corresponding to the cursor 1901 is displayed. As playing back of the speech proceeds, the cursor 1901 moves and the corresponding designation window 1910 also moves.

The designation window 1910 includes an OK button and a cancel button. For example, when the OK button is depressed, the data of the storage 121-4 is updated by adding 1 to the number of outputs of the corresponding word. When the cancel button is depressed, the number of outputs is not updated. It may be configured so that, when the designation window 1910 includes only the OK button and the OK button is not depressed, the number of outputs is not updated.

Figure 20:
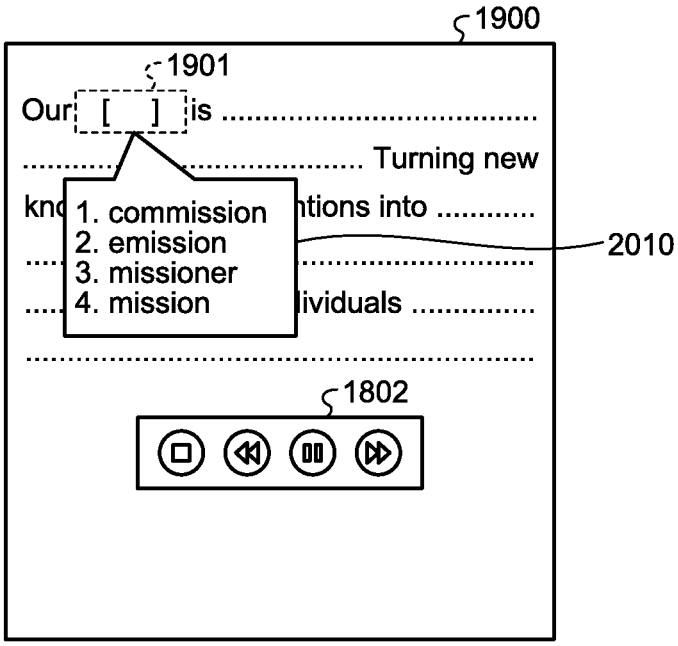
FIG. 20 is a diagram illustrating another example of the learning screen.

FIG. 20 is a diagram illustrating another example of the learning screen. In a learning screen 2000 in FIG. 20, the learning target (word, etc.) is not displayed and a selection window 2010 for selecting an answer is displayed. In the selection window 2010, a correct notation and the other notations of the corresponding word is selectably displayed. For example, when a correct notation is selected, the data of the storage 121-4 is updated by adding 1 to the number of outputs of the corresponding word. When the correct notation is not selected, the number of outputs is not updated. With such configuration, the number of correct answers may be stored instead of the number of outputs as the attribute.

Figure 21:
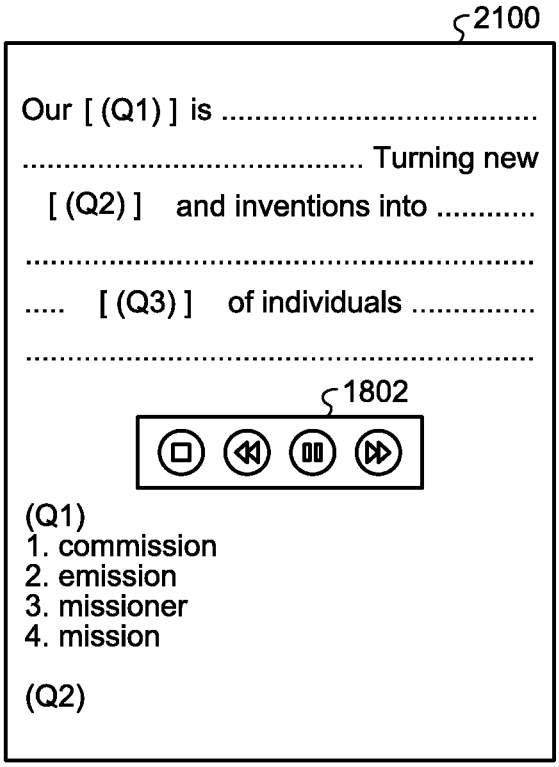
FIG. 21 is a diagram illustrating another example of the learning screen.

FIG. 21 is a diagram illustrating another example of the learning screen. A learning screen 2100 in FIG. 21 is an example of a screen in which choices are displayed below. The notation of the learning target (word, etc.) is not displayed. Instead, information associated with the choices below such as "Q1", "Q2", and "Q3" is displayed. The user can select a notation from the choices while the speech is played back or the playing back of the speech ends.

Next, another example of the attribute will be described.

In a school and the like, in order to proceed learning according to a predetermined plan, the learning target is changed in accordance with proceeding of the plan, in some cases. Thus, elapsed time from the start of learning, for example, the start of the speech output may be the attribute. In this case, the specifier 102-4 specifies different emphasis parts depending on the elapsed time. For example, the storage 121-4 stores a range of the elapsed time for each word, instead of the number of outputs in FIG. 17. The specifier 102-4 specifies the word included in a range of the elapsed time that is stored with the elapsed time from the actual start of the speech output, as the emphasis part. The number of repeated uses of the speech or the like, for example, the number of playing back of a file also may be added as the attribute.

A unit of learning such as a learning period and a unit number of learning may be the attribute. For example, the storage 121-4 stores information for identifying a plurality of learning periods (learning period 1, learning period 2, learning period 3 . . . ) for each word, instead of the number of outputs in FIG. 17. The specifier 102-4 specifies the word corresponding to the learning period designated by the user or the like, or to the learning period determined based on a predetermined plan and date, as the emphasis part.

A type of the learning target may be the attribute. For example, in a case of applying to history learning, the storage 121-4 stores, instead of the number of outputs in FIG. 17, a type which the learning target (word, sentence, etc.) indicates, such as the age and keywords as the attribute. The specifier 102-4 specifies the word corresponding to the type designated by the user or the like, or to the type determined based on the predetermined plan and date, as the emphasis part. In a case of applying to language learning or the like, the storage 121-4 may store a word class as the type (attribute).

A site to which the speech is output may be the attribute. For example, in a case of applying to the reading application, different emphasis parts may be specified depending on at least one of a site in which the reading application is executed and the number of outputs of the speech. This enables the speech to be output so that the user does not get tired even with, for example, contents of the same book.

The degree of priority determined for each learning target may be the attribute. The degree of priority represents the degree of preference for the target (partial speech corresponding to the target). The determination method of the degree of priority may be any method. For example, the user may select the word and may also designate the degree of priority. The degree of importance (or difficulty) of a predetermined word in dictionary data of words may be utilized as the degree of priority. The degree of priority needs not to be fixed and may be changed dynamically.

For example, the specifier 102-4 specifies the partial speech corresponding to the word having the degree of priority of a threshold value or more, as the emphasis part. The specifying part 102-4 may specify the partial speech corresponding to the word of a value of which the degree of priority is designated (designated value) or the word within a range designated (designated range), as the emphasis part. The threshold value, the designated value, and the designated range may be fixed values or may be capable of being designated by the user, or the like.

For example, the storage 121-4 stores the degree of priority for each word, instead of the number of outputs in FIG. 17. For example, the degree of priority of "1" is set to the words, "mission" and "knowledge", and the degree of priority of "2" is set to the word, "aspiration". For example, when the threshold value is "1", the specifier 102-4 specifies the partial speech corresponding to the "mission" and the "knowledge" as the emphasis part. When the range of the degree of priority can be designated, for example, the emphasis part can be changed according to the degree of importance (degree of difficulty) of the word.

It can be configured so that the degree of priority is changed according to other information. For example, the degree of priority may be changed according to the elapsed time from the start of the output of the speech. When controlling is performed so that the degree of priority of the word to be the learning target is increased according to the elapsed time and the degree of priority of the word not to be the target is decreased, learning in accordance with the plan as described above is possible.

For example, it may be configured so that the user is made to select an answer in a screen such as that in FIG. 20 and FIG. 21, and when it is correct, the degree of priority is decreased, and when it is not correct, the degree of priority is increased. Thereby, the target that the user has not learned sufficiently can be emphasized appropriately. Similar function can be achieved by making the number of correct answers to be the attribute.

Above description has described the example in which, while the speech corresponding to the text data is generated, the emphasis part is modulated, similarly to the first embodiment. The modulation method is not limited to this. For example, similarly to the second embodiment, the modulation processing may be performed to the speech corresponding to the emphasis part in the generated speech. The modulation method is not limited to the method of modulating at least one of the pitch and the phase. Other modulation method may be applied.

As above, in the speech processing apparatus according to the fourth embodiment, the emphasis part changed according to the attribute is modulated and output. Thereby, learning effect in a case of applying to the learning application can be increased and the sense of reality in a case of applying to the reading application can be increased.

As described above, according to the first to fourth embodiments, speech is output while at least one of the pitch and phase of the speech is modulated, and hence users' attention can be raised without the intensity of speech signals is not changed.

Figure 22:
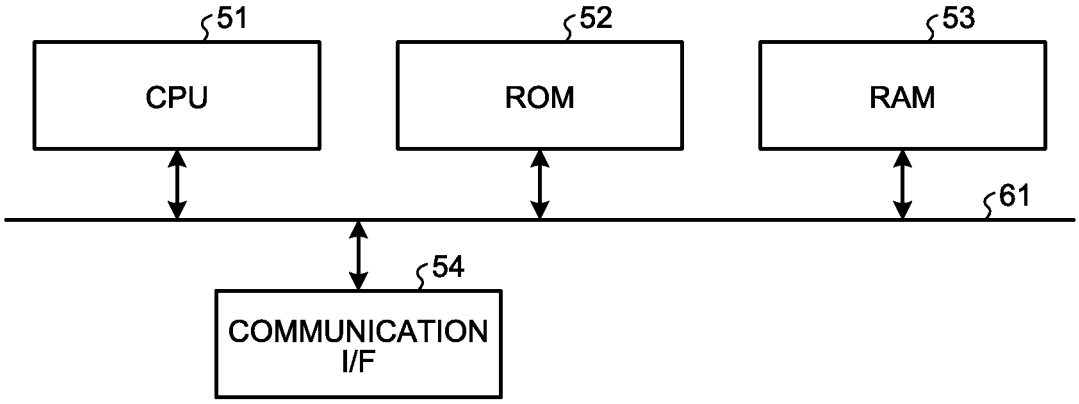
FIG. 22 is a hardware configuration diagram of the speech processing apparatus according to the embodiments.

Next, a hardware configuration of the speech processing apparatuses according to the first to fourth embodiments is described with reference to FIG. 22. FIG. 22 is an explanatory diagram illustrating a hardware configuration example of the speech processing apparatuses according to the first to fourth embodiments.

The speech processing apparatuses according to the first to fourth embodiments include a control device such as a central processing unit (CPU) 51, a storage device such as a read only memory (ROM) 52 and a random access memory (RAM) 53, a communication I/F 54 configured to perform communication through connection to a network, and a bus 61 connecting each unit.

The speech processing apparatuses according to the first to fourth embodiments are each a computer or an embedded system, and may be either of an apparatus constructed by a single personal computer or microcomputer or a system in which a plurality of apparatuses are connected via a network. The computer in the present embodiment is not limited to a personal computer, but includes an arithmetic processing unit and a microcomputer included in an information processing device. The computer in the present embodiment refers collectively to a device and an apparatus capable of implementing the functions in the present embodiment by computer programs.

Computer programs executed by the speech processing apparatuses according to the first to fourth embodiments are provided by being incorporated in the ROM 52 or the like in advance.

Computer programs executed by the speech processing apparatuses according to the first to fourth embodiments may be recorded in a computer-readable recording medium, such as a compact disc read only memory (CD-ROM), a flexible disk (FD), a compact disc recordable (CD-R), a digital versatile disc (DVD), a USB flash memory, an SD card, and an electrically erasable programmable read-only memory (EEPROM), in an installable format or an executable format, and provided as a computer program product.

Furthermore, computer programs executed by the speech processing apparatuses according to the first to fourth embodiments may be stored on a computer connected to a network such as the Internet, and provided by being downloaded via the network. Computer programs executed by the speech processing apparatuses according to the first to fourth embodiments may be provided or distributed via a network such as the Internet.

Computer programs executed by the speech processing apparatuses according to the first to fourth embodiments can cause a computer to function as each unit in the speech processing apparatus described above. This computer can read the computer programs by the CPU 51 from a computer-readable storage medium onto a main storage device and execute the read computer programs.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech processing apparatus, comprising:

an emphasis specification system implemented by one or more hardware processors and configured to specify a first time indicating a first position of a first emphasis portion of a first speech corresponding to at least one word to emphasize during output of the first speech and a second time indicating a second position of a second emphasis portion of a second speech corresponding to at least one word to emphasize during output of the second speech; and a modulator configured to modulate at least one audio characteristic of at least one of the first emphasis portion of the first speech to be output to a first speaker device and the second emphasis portion of the second speech to be output to a second speaker device such that the at least one audio characteristic is different between the first emphasis portion of the first speech and the second emphasis portion of the second speech, wherein the at least one audio characteristic comprises a pitch or a phase, wherein a degree of modulation of the at least one audio characteristic of the first emphasis portion or the second emphasis portion is based at least in part on an attribute of the first speech or the second speech, and wherein the attribute is at least one of:

a portion of speech to be output and a time for outputting the portion of speech, an elapsed time from a start of the output of the first speech and the second speech, or a degree of priority of the speech from a plurality of speeches to be output.

2. The speech processing apparatus according to claim 1, wherein the attribute further includes at least one of:

a site to which the speech is output, a type of a learning target that is learned by using the speech, or a period of learning determined based on a predetermined plan and date, during which the target of the learning is learned by using the speech.

3. The speech processing apparatus according to claim 1, wherein the emphasis specification system is further configured to specify the time based at least in part on input text data, and the modulator is further configured to generate the first speech and the second speech that correspond to the text data, the first speech and the second speech being obtained by modulating the emphasis portion of at least one of the first speech and the second speech such that at least one of the pitch and the phase of the emphasis portion is different between the emphasis portion of the first speech and the emphasis portion of the second speech.

4. The speech processing apparatus according to claim 1, further comprising a speech generator configured to generate the first speech and the second speech that correspond to input text data, wherein the emphasis specification system is configured to specify the time based at least in part on the text data, and the modulator is further configured to modulate the emphasis portion of at least one of the first speech and the second speech such that at least one of the pitch and the phase is different between the emphasis portion of the generated first speech and the emphasis portion of the generated second speech.

5. The speech processing apparatus according to claim 1, wherein the modulator is further configured to modulate the phase of the emphasis portion of at least one of the first speech and the second speech such that a difference between the phase of the emphasis portion of the first speech and the phase of the emphasis portion of the second speech is 60° or more and 180° or less.

6. The speech processing apparatus according to claim 1, wherein the modulator is further configured to modulate the pitch of the emphasis portion of at least one of the first speech and the second speech such that a difference between a frequency of the emphasis portion of the first speech and a frequency of the emphasis portion of the second speech is 100 hertz or more.

7. The speech processing apparatus according to claim 1, wherein the modulator is further configured to modulate the phase of the emphasis portion of at least one of the first speech and the second speech by reversing a polarity of a signal input to the first output unit or the second output unit.

8. A speech processing method, comprising:

specifying a first time indicating a first position of a first emphasis portion of a first speech corresponding to at least one word to emphasize during output of the first speech and a second time indicating a second position of a second emphasis portion of a second speech corresponding to at least one word to emphasize during output of the second speech; and modulating at least one audio characteristic of at least one of the first emphasis portion of the first speech to be output to a first speaker device and the second emphasis portion of the second speech to be output to a second speaker device such that the at least one audio characteristic is different between the first emphasis portion of the first speech and the second emphasis portion of the second speech, wherein the at least one audio characteristic comprises a pitch or a phase, wherein a degree of modulation of the at least one audio characteristic of the first emphasis portion or the second emphasis portion is based at least in part on an attribute of the first speech or the second speech, and wherein the attribute is at least one of:

a portion of speech to be output and a time for outputting the portion of speech, an elapsed time from a start of the output of the first speech and the second speech, or a degree of priority of the speech from a plurality of speeches to be output.

9. A computer program product having a non-transitory computer readable medium including programmed instructions, wherein the instructions, when executed by a computer, cause the computer to perform:

specifying a first time indicating a first position of a first emphasis portion of a first speech corresponding to at least one word to emphasize during output of the first speech and a second time indicating a second position of a second emphasis portion of a second speech corresponding to at least one word to emphasize during output of the second speech; and modulating at least one audio characteristic of at least one of the first emphasis portion of the first speech to be output to a first speaker device and the second emphasis portion of the second speech to be output to a second speaker device such that the at least one audio characteristic is different between the first emphasis portion of the first speech and the second emphasis portion of the second speech, wherein the at least one audio characteristic comprises a pitch or a phase, wherein a degree of modulation of the at least one audio characteristic of the first emphasis portion or the second emphasis portion is based at least in part on an attribute of the first speech or the second speech, and wherein the attribute is at least one of a portion of speech to be output and a time for outputting the portion of speech, an elapsed time from a start of the output of the first speech and the second speech, or a degree of priority of the speech from a plurality of speeches to be output.

10. The speech processing apparatus according to claim 1, wherein the modulator modulates the emphasis portion of at least one of the first speech and the second speech such that the emphasis portion having the smaller number of outputs is modulated with larger modulation strength.

* * * * *